United States Patent [19]

Spirer

[11] 4,000,707

[45] Jan. 4, 1977

[54] TUFTED PILE FABRIC AND METHOD OF MAKING SAME

[75] Inventor: Peter R. Spirer, Coral Gables, Fla.

[73] Assignee: Horizon Industries, Inc., Dalton, Ga.

[22] Filed: Dec. 16, 1974

[21] Appl. No.: 532,766

[52] U.S. Cl. ..... 112/410; 112/266

[51] Int. Cl.[2] ..... D05C 17/02

[58] Field of Search ..... 112/410, 266, 262, 79 R; 428/89

[56] References Cited

UNITED STATES PATENTS

| | | | |
|---|---|---|---|
| 3,386,403 | 6/1968 | Short | 112/266 |
| 3,396,687 | 8/1968 | Nowicki | 112/410 X |
| 3,850,783 | 11/1974 | Peters | 428/89 |
| 3,875,883 | 4/1975 | Eberwein | 112/266 |

*Primary Examiner*—Werner H. Schroeder
*Assistant Examiner*—Peter Nerbun
*Attorney, Agent, or Firm*—Bell, Seltzer, Park & Gibson

[57] ABSTRACT

A tufted pile fabric and method of making the same wherein the fabric has visually distinct pile areas which present different color and pattern effects in both the longitudinal and transverse directions. At least two differently colored yarns are alternately arranged in the rows of tufts, and the pile areas include a first area wherein one of the yarns is substantially concealed, a second pile area wherein the other of the yarns is substantially concealed, and a third pile area wherein both yarns are substantially equally visible. The first, second and third pile areas are arranged in longitudinally extending groups of rows of tufts, and the pile areas are also arranged in a predetermined orientation with respect to the particular pile areas of adjacent groups to thereby achieve a geometric pattern which extends both longitudinally and transversely through the fabric.

14 Claims, 5 Drawing Figures

TUFTED PILE FABRIC AND METHOD OF MAKING SAME

The present invention relates to a tufted pile fabric which is primarily adapted for use as a carpet or rug, and which achieves unique color and pattern effects.

In recent years, tufting has largely replaced weaving in the fabrication of many pile fabrics, such as carpets and rugs, by reason of the high rate of production obtainable in a tufting operation as compared with the more conventional weaving operations. While tufting possesses this advantage of a high rate of production, its full potential has nevertheless not been realized since the range of pattern and design effects achievable with the tufting operation has heretofore been severely limited. For example, an embossed pattern effect has been achieved in a tufting operation by varying quantities of yarn delivered to each needle to result in a high-low loop configuration which gives rise to the desired pattern. Also, another limited pattern effect has been achieved in a tufting operation through the use of a selected arrangement of variously colored yarns in the bank delivered to the needles. However, none of the known patterning arrangements for a tufting operation approach the wide range of color and pattern effects achievable through conventional highly patterned weaving, such as an Axminster weaving operation, and manufacturers have had to resort to the slow and more expensive weaving operations where such pattern effects are desired.

It is accordingly an object of the present invention to provide a tufted pile fabric and method of fabricating the same which is adapted to achieve a wide range of color and pattern effects such as is presently obtainable only by the slow and more expensive weaving operations.

It is another object of the present invention to provide a tufted pile fabric having a geometric pattern which extends both longitudinally and transversely of the fabric.

It is a further object of the present invention to provide a tufted pile fabric incorporating a color and pattern effect which gives rise to a plaid appearance, and wherein the yarns employed have a subtle color variation along their length to provide a mellow visual appearance in the various colored areas of the fabric.

It is still another object of the present invention to provide a tufted pile fabric wherein the fabric comprises two differently colored yarns alternately positioned in substantially all of the rows of tufts, and which incorporates a visually distinct area wherein the tufts formed of the yarns are of equal height so that both yarns are equally visible, and which further incorporates a zig-zag configuration in the rows of tufts to achieve a substantial blend of the two colors within such pile area.

These and other objects and advantages of the present invention are achieved in the embodiment illustrated herein by the provision of a tufted pile fabric which has groups of longitudinal rows of pile tufts, and with the pile yarn of alternate rows in each group being of color characteristics differing from substantially all of the pile yarns of the intervening rows therein. Each group of rows of pile tufts further forms differing pile areas, includng a first pile area having high pile tufts in the alternate rows and low pile tufts in the intervening rows such that the low pile tufts (i.e. intervening rows) are substantially concealed, a second pile area having high pile tufts in the intervening rows and low pile tufts in the alternate rows such that the low pile tufts (i.e. alternate rows) are substantially concealed, and a third pile area having tufts of substantially common height such that the yarns of both rows are equally visible. The first, second, and third pile areas are arranged in a predetermined pattern within each group and among the various groups to thereby present different color pattern effects both longitudinally and transversely of the pile fabric.

The above described tufted pile fabric is preferably fabricated from spaced dyed yarns having a subtle color variation along their length to provide a mellow visual appearance in the finished fabric, and the rows of tufts are preferably in a zig-zag configuration to preclude any line effect of the differently colored yarns within the above described third pile area and thereby achieve a random appearance or substantial blend of the two colors therewithin. Further, the high pile tufts in all of the above described pile areas are preferably cut to provide additional body and covering ability therein.

Some of the objects of the invention having been stated, other objects will appear as the description proceeds when taken in connection with the accompanying drawings, in which.

Figure 1:
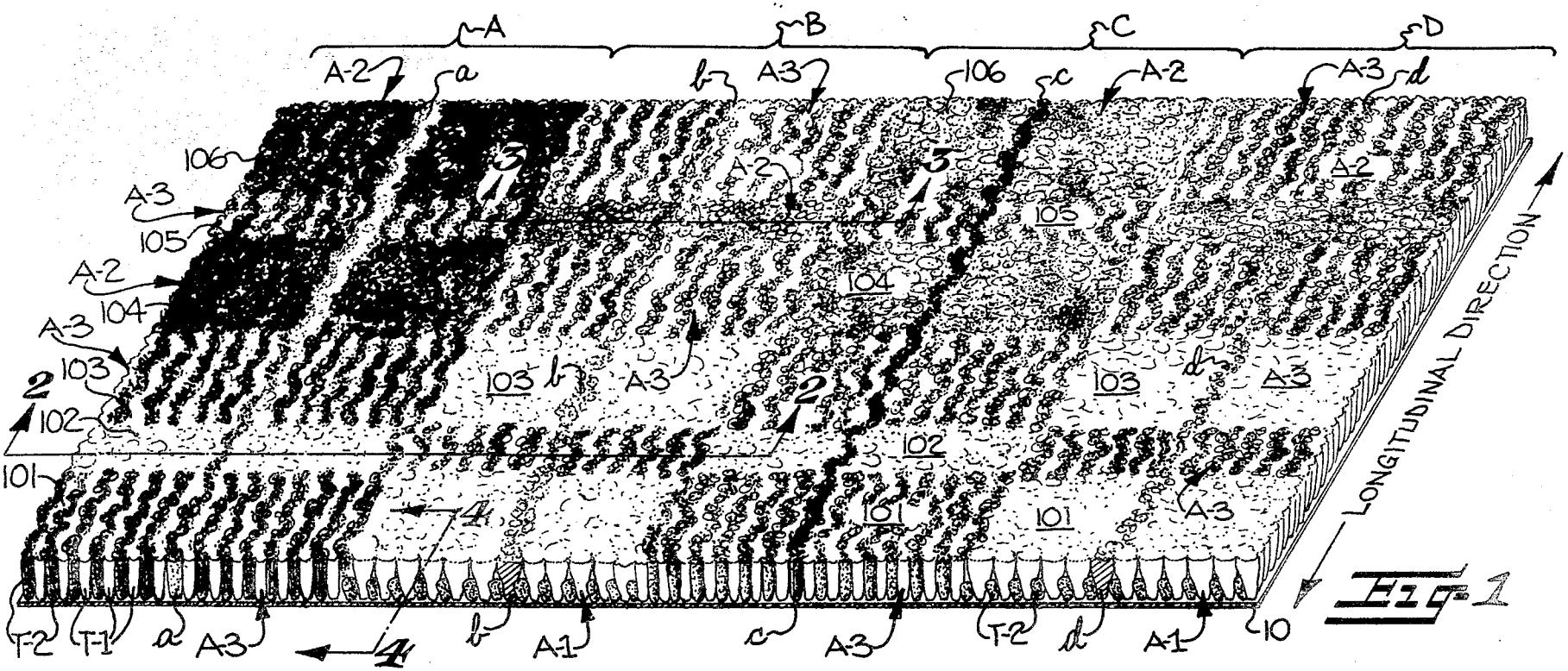
FIG. 1 is a fragmentary perspective view showing the upper or pile face of one pattern repeat of a preferred embodiment of an improved tufted pile fabric incorporating the features of the present invention.
Figure 5:
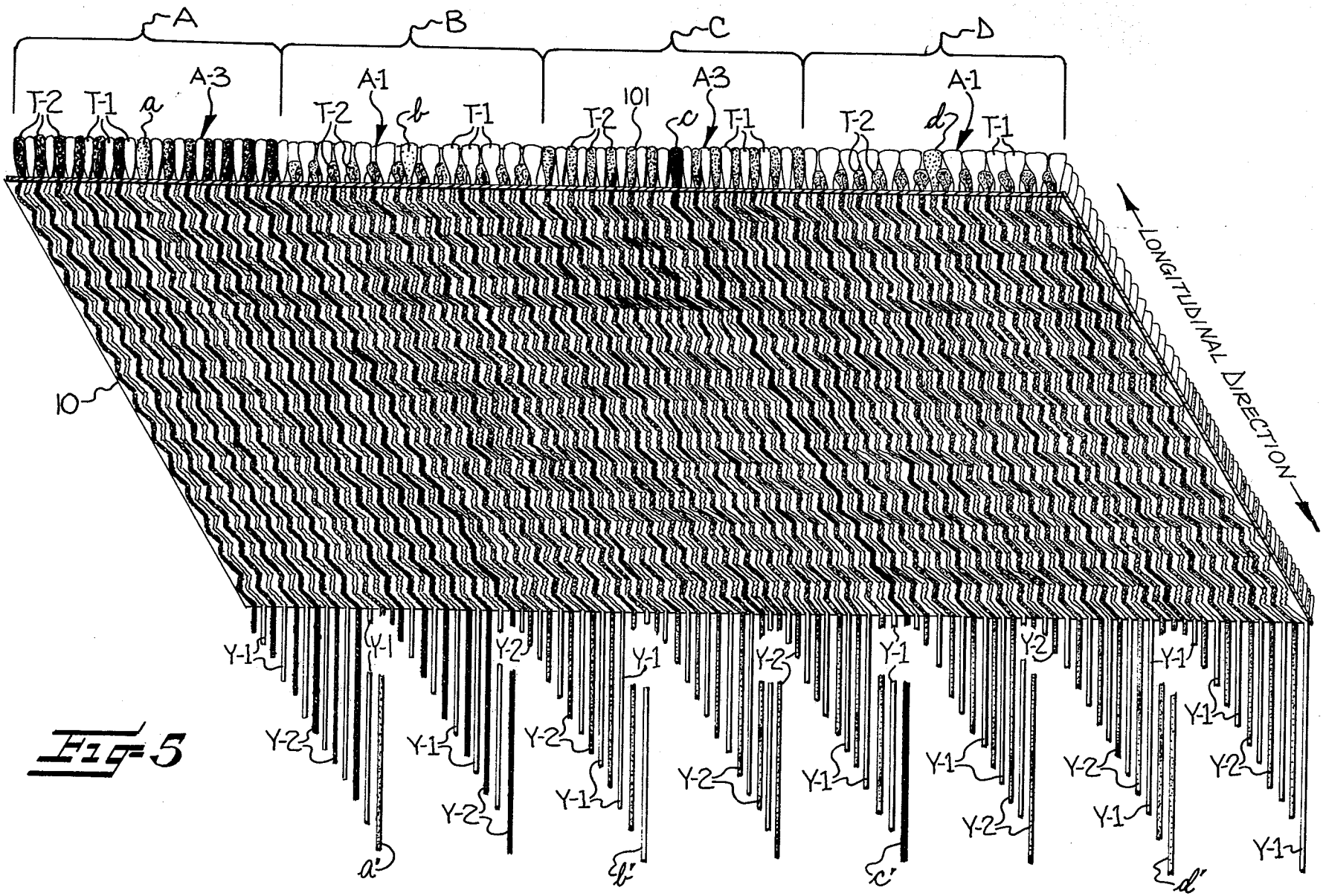
FIG. 5 is a fragmentary perspective view of the rear or back face of the pattern repeat of the fabric, and showing an array of pile yarns along the lower portion thereof.

Referring more specifically to the drawings, the tufted pile fabric of this invention comprises a base fabric or sheet of backing material 10, preferably in the form of a nonwoven fibrous fabric. However, the base 10 may be in the form of a woven fabric, or in the form of a sheet of plastic material, or any other desired pliable material, as is well known in the art of tufting. A single pattern repeat of the pile fabric is shown in FIGS. 1 and 5, and the indicated longitudinal direction of the fabric is in accord with the machine direction of the fabric; i.e., the direction in which the longitudinal rows of tufts extend in the fabric. Although only a single pattern repeat is shown in FIGS. 1 and 5, it is apparent that the pile fabric may include any desired number of such pattern repeats in the longitudinal and/or transverse directions thereof.

The tufted pile fabric comprises a plurality of groups of longitudinal rows of pile tufts defining respective longitudinally arranged pile areas, there being four groups A, B, C, D of longitudinal rows of pile tufts in the illustrated pattern repeat of FIGS. 1 and 5. As shown in FIG. 1, each group of rows of pile tufts includes a plurality of different types of pile areas which are longitudinally arranged in a predetermined pattern within each group and among the various groups to present different color and pattern effects both longitudinally and transversely of the pile fabric. In this regard, it will be noted that substantially all of the groups A through D are of substantially the same transverse width, and the pile areas in each such group are positioned so as to define a pair of longitudinally arranged, visually distinct squares in each pattern repeat, with each square being of a longitudinal extent substantially equal to the width of each group of rows of pile tufts. The pile areas in each of the groups A through D further collectively define transversely extending rows of pile areas, as will be further described below.

Referring now to FIG. 5, it will be observed that each group A through D of longitudinal rows of pile tufts is formed of a plurality of pile yarns, an array of portions of the pile yarns being shown schematically extending from the lower edge portion of the fabric in FIG. 5. In the illustrated embodiment, longitudinal rows of pile tufts are of zig-zag configuration, and the rows are preferably formed of high bulk carpet yarns with adjacent rows of tufts positioned in closely spaced substantially parallel relationship to provide full coverage of the base fabric 10.

The pile yarns of substantially all of the alternate rows T-1 of pile tufts in each group A through D are designated at Y-1, and the pile yarns of substantially all of the intervening rows T-2 of pile tufts in each group are designated at Y-2. It is to be noted that the pile yarns Y-1 of substantially all of the alternate rows T-1 of pile tufts in each group are of different color characteristics from the pile yarns Y-2 of substantially all of the intervening rows T-2 of pile tufts in such group. Also, it is preferred that the pile yarn of each of the rows of pile tufts is of varying color characteristics along its length as hereinafter further described.

Figure 3:
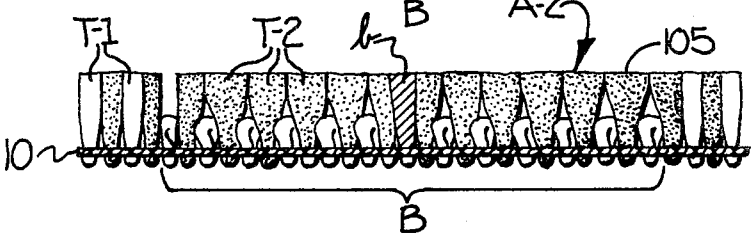
FIG. 3 is a fragmentary transverse vertical sectional view taken substantially along line 3—3 in FIG. 1 and showing another type of pile area.

As indicated above, each group A through D of rows of pile tufts forms longitudinally arranged pile areas of different types. Such different type pile areas include a first type pile area A-1 as best seen in the lower portion of each of the groups B and D in FIG. 1. More particularly, area A-1 has high pile tufts in the alternate rows T-1, and low pile tufts in intervening rows T-2 such that the high pile tufts in the alternate rows T-1 substantially conceal the low pile tufts in the intervening rows T-2. A second type pile area A-2 is shown in FIG. 3, and represents the reverse of each of the first type pile areas A-1, to the extent that each second type pile area A-2 has high pile tufts in the intervening rows T-2 and low pile tufts in the alternate rows T-1.

Since the pile yarns Y-1 (FIG. 5) are of different color characteristics from the pile yarns Y-2 in each respective group A through D of rows of pile tufts, it will be appreciated that the visible tufts in the first type pile areas A-1 will exhibit the color characteristics of the respective pile yarns Y-1. Conversely, it is apparent that the visible tufts in the second type pile areas A-2 will exhibit the color characteristics of the respective pile yarns Y-2.

The different types of pile areas also include a third type pile area A-3, there being three of such third type pile areas A-3 shown in each group A through D of rows of pile tufts in the pattern repeat of FIG. 1. Each third type pile area A-3 has the pile tufts in both the alternate and intervening rows T-1, T-2 thereof of substantially common height and preferably of about the same height as the high tufts in each of the first and second types of pile areas A-1, A-2. The pile areas of the third type A-3 are best shown in the right-hand portion of FIG. 2, and in the lowermost portion of each of the groups A and C as seen in FIG. 1. From the foregoing description, it is apparent that the visible tufts in each third type pile area A-3 present the color characteristics of both respective pile yarns Y-1, Y-2 (FIG. 5) substantially equally so as to impart a mottled appearance thereto.

In the illustrated embodiment, one of the third type pile areas A-3 serves as each alternate pile area in each of the groups A through D of rows of pile tufts, and the intervening pile areas between such alternate pile areas in each respective group are either of the first type A-1 or of the second type A-2. As shown, some of the intervening pile areas in each group of rows of pile tufts are of the first type A-1 and other of the intervening pile areas are of the second type A-2.

The pile areas in each group of rows of pile tufts are consecutively numbered 101–106 in FIG. 1, it thus being apparent that there are six pile areas longitudinally arranged in each of the groups A through D in each pattern repeat, with the longitudinal extent of each pile area being less than its widthwise extent. It will also be seen that the pile areas 101–106 define respective transverse rows of visually distinct pile areas of different types, and that the set of three contiguous pile areas 101–103 in each group forms a first pile square, and the set of three other contiguous pile areas 104–106 in each group forms another or second pile square in each repeat. The thus defined pile squares are also substantially aligned transversely of the fabric to define a pattern of such squares extending both longitudinally and transversely of the fabric and which gives rise to a plaid effect as hereinafter further described.

It will be observed in FIG. 1 that, in the first group A of rows of pile tufts, the pile area 102 is of the first type A-1, the pile areas 104, 106 are of the second type A-2, and the pile areas 101, 103, 105 are of the third type A-3. Further, the pile areas 101, 103, 104, 106 in each group A through D preferably are of substantially the same longitudinal extent throughout the pattern repeat, while the longitudinal extent of each of the pile areas 102, 105 in each group is substantially less than that of former pile areas, e.g., about one-fourth to one-half of the longitudinal extent thereof. Thus the pile areas 102, 105 define transversely extending relatively narrow strips as further described below.

As noted above, each of the rows of pile tufts in each group A through D is illustrated as being of zig-zag configuration throughout the length thereof, note FIG. 5. Such zig-zag configuration of the rows of pile tufts is desirable in order to impart a random appearance or blend of the different colors or shades of tufts in each of the third type pile areas A-3, and also to enhance the varied color appearance of the entire pile fabric. As further illustrated in FIG. 5, not only are the zig-zag rows of pile tufts disposed in spaced substantially parallel relation to each other, but they also include successive diagonally exending sections between the bends in the rows, with each section having a plurality of pile tufts therein.

The above described zig-zag configuration of the rows of pile tufts may be effected by advancing the base fabric 10 in the longitudinal or machine direction through a suitable tuft forming zone, such as a row of tufting needles and corresponding loopers (not shown), while repeatedly shifting the base fabric 10 first in one transverse direction for a plurality of steps and then in the opposite transverse direction for a plurality of steps, and while forming a transverse row of pile tufts following each of such steps. Thus, each zig-zag row of pile tufts will have successive diagonally extending sections with each such section having several successively aligned pile tufts therein. Any suitable or conventional means may be employed in association with a tufting machine for imparting a zig-zag configuration to the rows of tufts being formed. A suitable apparatus of this type is shown in U.S. Pat. No. 3,393,654, granted to Richard L. Barnes on July 23, 1968.

Figure 2:
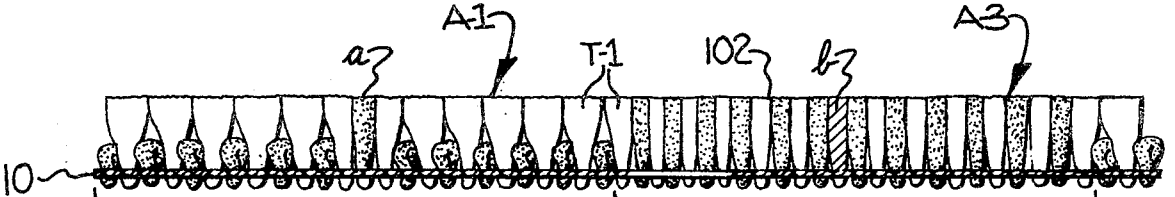
FIG. 2 is a fragmentary transverse vertical sectional view through two different types of pile areas of the pile fabric and taken substantially along line 2—2 in FIG. 1.
Figure 4:
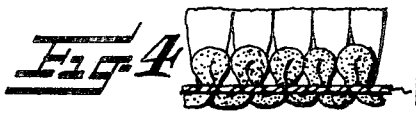
FIG. 4 is a fragmentary vertical sectional view taken in the longitudinal direction of the fabric and substantially along line 4—4 in FIG. 1.

It will be observed in FIGS. 1, 2 and 4 that all of the high pile tufts in each of the pile areas of the first an second types A-1, A-2, as well as all of the tufts in each of the third type pile areas A-3, are cut pile tufts. Additionally, all of the low pile tufts in the first and second types of pile areas A-1, A-2 are in the form of loop pile tufts. Alternatively, the low pile tufts could be in the form of cut pile tufts, and the high tufts could be in the form of loop pile tufts. However, the use of cut pile tufts in the first and second pile areas has been found to provide additional body and covering ability therein, and cut pile tufts also give rise to additional body and an improved appearance in the third pile areas.

The desired selection in tuft height and construction may be achieved in accordance with the present invention by utilizing a tufting machine having a suitable patterning apparatus as known in the art. For example, U.S. Pat. No. 3,075,482 granted to Roy T. Card on Jan. 29, 1963, illustrates a typical patterning apparatus which may be utilized for selectively varying the length of the pile tufts being formed in a base fabric.

It is to be noted that, in order to enhance the plaid effect of several of the pattern repeats of FIG. 1 forming a single carpet or rug, it is preferred that the pile areas 101–106 in the first group A of rows of pile tufts of each repeat has about every other row of tufts thereof; i.e., most of the intervening rows of tufts T-2, formed of a respective pile yarn Y-2 of darker color characteristics than most of the pile yarns present in the other groups B, C, D. Also, it will be observed that the first, second and third types of pile areas in each alternate group A, C of rows of pile tufts are offset in the longitudinal or machine direction with respect to the different types of pile areas in each intervening group B, D. Stated otherwise, it will be observed in FIG. 1 that, with the exception of the longitudinal rows of pile tufts in group A being of different color characteristics from the longitudinal rows of tufts in group C, these two alternate groups A, C have the pile areas 101–106 therein arranged in substantially the same order, i.e., the pile areas 101, 103, 105 thereof are of the third type A-3, the pile areas 102 thereof are of the first type A-1, and the pile areas 104, 106 are of the second type A-2. On the other hand, it will be observed that the pile areas 101, 103 in the intervening groups B, D of the rows of pile tufts are of the first type A-1, with the pile areas 102, 104, 106 in these same groups being of the third type A-3, and with the pile areas 105 being of the second type A-2.

As heretofore indicated, and as is clearly illustrated in FIG. 1, it is preferred that all of the pile areas 101, 103, 104, 106 be of substantially the same longitudinal extent in all of the groups throughout the width of each pattern repeat, with all of the pile areas 102, 105 being of substantially less longitudinal extent than the other pile areas throughout the width of each pattern repeat. Thus each set of contiguous pile areas 101, 102, 103 and each set of contiguous pile areas 104, 105, 106 substantially defines a pile square. Accordingly, it will be noted that the major area portion of each pile square comprises a pair of spaced apart pile areas, with the remaining area portion being disposed therebetween in the form of a narrow transverse strip of pile disposed substantially centrally within the respective square and being formed from another of the different types of pile areas. Such remaining area portion of each square is substantially transversely aligned with the respective remaining area portions of the adjacent pile squares so as to present a visible transverse line effect across the pile fabric.

In this regard, the major area portion of the low left-hand pile square in FIG. 1 comprises the pair of pile areas 101, 103 of the third type A-3, and the remaining area portion 102 is of the first type A-1 and is in the form of a narrow strip positioned substantially centrally within the respective pile square. In the next transversely adjacent pile square at the bottom of the group B, the major area portion is of the first type A-1 and the remaining, narrow strip, area portion is of the third type A-3. The upper left-hand pile square in the group A is a pile square whose major area portion is of the second type A-2 and whose remaining, narrow strip, area portion is of the thrd type A-3, and the pile square in the upper half of the group B illustrates a major area portion of the third type A-3 with the remaining, narrow strip, area portion being of the second type A-2.

In order to further enhance the plaid effect of the pile fabric, it is preferred that at least some and preferably all of the groups A through D of rows of pile tufts have respective contrasting rows of tufts extending longitudinally thereof and presenting a visible longitudinal line effect centrally through the respective pile areas. As illustrated, a contrasting row of pile tufts is positioned substantially in the center of and extends throughout the length of each group A through D. Accordingly, the contrasting rows of pile tufts in the groups A, B, C, D in FIG. 1 are respectively indicated at *a*, *b*, *c*, *d*, and the respective yarns from which they are formed are indicated at *a'*, *b'*, *c'*, *d'* in FIG. 5. In order that the contrasting rows of tufts *a* through *d* will present respective visible longitudinal line effects in the pile fabric, the pile yarns *a'* through *d'* are of different color characteristics from adjacent pile tufts. Thus the narrow strips defined by the pile areas 102, 105 form transversely extending lines which extend centrally through the transversely aligned pile squares and across the fabric, while the contrasting rows of pile tufts form longitudinally extending lines which extend centrally through the longitudinally aligned pile squares.

As a further aspect of the present invention, it is preferred to utilize space dyed yarn having varying color characteristics along the length thereof in constructing the pile fabric of the present invention. More particularly, it has been found that long space dyed yarn having a subtle shade variation of a predominant color serves to relieve and mellow the visual contrast between the various pile areas, and thus further enhances the appearance of the fabric. Such long space dyed yarn may be produced by a skein dyeing operation as known in the art, and wherein each variation in color extends for a relatively long distance along the length of the yarn.

A particular example of a pile fabric embodying the present invention will now be described in more detail. The fabric was fabricated with the transverse center-to-center distance between the longitudinal zig-zag rows of tufts being about ¼ inch (6.35 millimeters), with each row containing about ten tufts per inch; i.e., about ten needle insertions per inch. The zig-zag rows of tufts had an amplitude of about ¼ to ⅜ inch (6.35 to 9.53 millimeters), with the distance between the opposite ends of each diagonally extending section of the rows of tufts, measured longitudinally of the pile fabric, being about ⅜ inch (9.53 millimeters). Each such section had four tufts (needle insertions) therein.

Further, in accordance with the present example, there were about 25 rows of pile tufts in each group A through D thereof. Also, all of the rows T-1, T-2 and *a* through *d* of pile tufts were formed of pile yarns having varying color characteristics or shade variation along the length of the rows thereof, and as described above. As indicated in the left-hand portions of FIGS. 1 and 5, the alternate rows T-1 of pile tufts, formed of the alternate pile yarns Y-1, in group A were predominantly white or of light color, while the intervening rows T-2 of pile tufts in group A were predominantly of a dark color, namely a dark green. Thus, since the alternate areas 101, 103, 105 are of the third type A-3, it is apparent that the corresponding portions of the respective rows of pile tufts T-1, T-2 were substantially equally visible to exhibit the respective colors thereof. Of course, the pile areas 102 in the first group A exhibited only the white with the exception of the longitudinal line effect formed therein by the contrasting row of tufts *a*. On the other hand, each of the pile areas 104, 106 in group A exhibited only the dark green color, with the exception of the contrasting visible longitudinal line effect therethrough. In this regard, it has been found that a highly pleasing aesthetic plaid pattern effect was obtained in the exemplary fabric formed according to the present invention by utilizing a light green yarn *a'*, which was of varying shades of light green along the length thereof, and with all of the tufts in the contrasting row *a* being high cut pile tufts.

As indicated above, the alternate rows T-1 of tufts in the group A were white or of off-white varying shades of color along their lengths and the intervening rows T-2 of tufts in group A were dark green of varying shades along their lengths. It is to be noted that the alternate rows T-1 of tufts in each of the other groups B, C, D also were white or of off-white varying shades along their lengths, and all of the intervening rows T-2 of tufts in each of the groups B, C, D, were of predominantly light green color, the light green yarns also being of varying shades of color, along their lengths. Thus, to obtain an aesthetic contrasting visible longitudinal line effect of the contrasting rows *b, c, d*, the pile yarn *b', c', d'* of which the respective rows *b, c, d* of tufts were formed were of gold, light green and gold colors, respectively, with the respective colors being of varying shades along the lengths.

There are instances in which the pile yarns of which the contrasting rows *a* through *d* of pile tufts are formed, might not present as sharp a contrasting line effect in one or more pile areas in a particular group of rows of pile tufts as would be the case in one or more other pile areas in the same group. In such instances, it may be desirable to further enhance the longitudinal line effect in such pile areas. Such further enhancement of the longitudinal line effect may be achieved in a pile area of the third type A-3, for example, by providing alongside the visible tufts of the contrasting row, other visible tufts of that different colored yarn otherwise present in the respective third type pile area A-3 and which contrasts the most with the respective contrasting row *a* through *d*. In some instances, enhancement of the longitudinal line effect also may be achieved by providing short or low tufts of the pile yarns *a', b', c', d'* in the respective portions of the contrasting rows and also by providing other visible high tufts of the pile yarns of one or more adjacent rows of tufts in the particular pile area, with the latter high pile tufts constrasting with still other adjacent high pile tufts of the same pile area.

As an example of how the above contrasting line effect may be further enhanced, it will be noted that, instead of the contrasting line effect being effected by high pile tufts of the aforementioned light green pile yarn *a'* in the central portion of the pile area 105 (type A-3) of group A in accordance with the foregoing example, the respective portion of the contrasting row *a* may have the pile yarn *a'* thereof formed into low pile tufts which would be substantially concealed by the high pile tufts of the two adjacent rows T-1 of tufts then straddling the respective portion of the contrasting row *a* and formed of the relatively light colored or white pile yarn. Thus, a small solid white or solid light-colored pile area portion would be visible in the central portion of the pile area 105 in the left-hand upper portion of FIG. 1.

Also, since the pile areas 104, 106, which are of the type A-2, are predominantly of dark green color in the foregoing example, and since the pile yarn *a'* is of light green color, the longitudinal line effect in the central portions of the pile areas 104, 106 in group A may be further enhanced by providing either or both of the two white rows T-1h, adjacent to and straddling the high tufts of row *a*, in the form of white, high pile tufts. In this regard, it is to be noted that, otherwise, all of the longitudinal rows T-1 of pile tufts formed of the white pile yarns Y-1 in pile areas 104, 106 in group A are in the form of low pile tufts substantially concealed by the high pile tufts of the intervening rows T-2 formed of the dark green pile yarns Y-2.

With the latter arrangement, it is apparent that white tufts in the predominantly green pile areas 104, 106 of group A may partially or entirely isolate the light green contrasting row *a* of pile tufts from the adjacent dark green rows of pile tufts. Thus, such white rows of tufts would emphasize the presence of the contrasting row *a* of tufts. Similar variations in the structure of other of the pile areas may be present where further enhancement is desired in the longitudinal line effects produced at the contrasting rows *a* through *d* of tufts. Still further, the longitudinal line effect could be enhanced by employing the contrasting yarn in a plurality of adjacent rows of tufts, rather than a single row as illustrated.

As will be apparent from FIG. 5, the tufted pile fabric of the present invention may be made by arranging a plurality of pile yarns in a plurality of groups of alternate and intervening pile yarns through a tufting zone, and with the alternate pile yarns being of color characteristics differing from substantially all of the intervening pile yarns. The thus arranged pile yarns are then formed into a plurality of longitudinal, preferably zigzag, rows of pile tufts of pile yarns, with the rows being arranged in a plurality of groups of rows of pile tufts according to the groups of pile yarns and in accordance with the longitudinally arranged pile areas to be formed of the groups of rows of pile tufts. It is thus apparent that the pile yarns of substantially all of the alternate rows in each group are of different characteristics from substantially all of the pile yarns of the intervening rows in each group.

According to one aspect of the method of the present invention, during the forming of the groups of longitudinal rows of pile tufts, each group is formed into longitudinally arranged pile areas of different types, namely types A-1, A-2, and A-3 as defined above. Also, during the forming of the first, second and third types of pile areas, they are arranged in a predetermined pattern within each group and among the various groups of rows of pile tufts to present different color and pattern effects both longitudinally and transversely of the pile fabric.

As indicated earlier herein, a zig-zag configuration is imparted to each row T-1, T-2, *a, b, c, d* of tufts being formed by advancing the base fabric 10 in a machine direction through the tuft forming zone while repeatedly shifting the base fabric 10 first in one transverse direction for a plurality of steps and then in the opposite transverse direction for a plurality of steps so as to form each row of tufts with successive diagonally extending sections therein, and wherein each such section has several successively aligned pile tufts therein.

In accordance with another aspect of the present method, each of certain adjacent pairs of the groups of rows of pile tufts is formed into longitudinally arranged alternate and intervening pile areas of different types, while the alternate pile areas are being arranged in one of the groups of such adjacent pairs in longitudinally offset relation to the alternate pile areas of the other respective group. As is the case with respect to the first aspect of the method of the invention, it is apparent that the forming of the different types of pile areas in each group of rows of pile tufts includes forming each of the alternate pile areas, such as the pile areas 101, 103, 105 in each group A, C and the pile areas 102, 104, 106 in each group B, D, with the tufts of the alternate and intervening rows thereof being of substantially common height.

On the other hand, the intervening pile areas between such alternate pile areas are formed with the tufts in some of the rows thereof in the form of low tufts and the tufts in other of the rows thereof in the form of high tufts such that the high tufts substantially conceal the low tufts. In this regard, it will be noted that high pile tufts are formed in the alternate rows T-1 and low pile tufts are formed in the intervening rows T-2 in the pile area 102 in each group A, C and in the pile areas 101, 103 in each group B, D. Also, high pile tufts are formed in the intervening rows T-2 and low tufts are formed in the alternate rows T-1 in the other intervening pile areas, such as the pile areas 104, 106 in each group A, C and the pile area 105 in each group B, D of the pattern repeat shown in FIG. 1.

According to still another aspect of the method of the present invention, at least a pair of pile areas of the third type A-3 are diagonally positioned with respect to each other and with respect to the longitudinal and transverse directions of the fabric in at least certain adjacent pairs of side-by-side groups of rows of pile tufts, such as the groups A, B of FIG. 1. More specifically, it will be observed in FIG. 1 that pile area 103 of group A and pile area 104 of group B are both type A-3 pile areas and are positioned diagonally with respect to each other. Additionally, the method includes thee forming of first and second types of pile areas A-1, A-2, respectively, in diagonal relationship with respect to each other and with respect to the longitudinal and transverse directions of the fabric, as exemplified by the areas 103, 104 in the respective groups B, A of the rows of pile tufts. Also, it will be noted that the diagonally positioned first and second types of pile areas A-1, A-2 are thus positioned beside and transversely of the respective diagonally positioned pile areas of the third type A-3. Similarly, diagonally positioned pile areas of the three different types A-1, A-2, A-3 are shown in the central transverse portion of the pattern repeat of FIG. 1 at the juncture of the groups B, C and at the juncture of the groups C, D, respectively, of the rows of pile tufts.

Although all of the groups A through D of rows of pile tufts are shown as being provided with pile areas 101–106 therein and are positioned in side-by-side relationship along the width of the pattern repeat, it is apparent that stripes or other longitudinal configurations of pile areas may extend between the adjacent longitudinal groups of rows of pile tufts and/or between adjacent pattern repeats, if desired, without departing from the invention.

Throughout the specification and claims, the terms "alternate" and "intervening" are used to identify the preferred arrangement of the pile yarns Y-1, Y-2 and the respective rows T-1, T-2 of the pile tufts in each group in each repeat. However, it is to be understood that the number of rows present in adjacent groups of pile areas may be varied according to a desired pattern and, therefore, there may be instances in which the alternate and intervening rows of tufts in a particular group of rows might be the equivalent of respective intervening and alternate rows of tufts in an adjacent group in the overall pattern repeat. Also, although a single strand of yarn is shown in FIG. 5 forming each respective row of pile tufts, it is to be understood that some or all of the rows T-1, T-2, *a, b, c* and/or *d* of pile tufts may be formed of two or more respective pile yarns, provided that the pile yarns of substantially all the alternate rows of pile tufts in each group are of different color characteristics from substantially all of the pile yarns of intervening rows of pile tufts in each respective group.

It is thus seen that there is provided an improved tufted pile fabric and method of making the same wherein groups of longitudinal rows of pile tufts define longitudinally arranged pile areas which present different color and pattern effects within each group and among the various groups, and thereby provide a unique pattern effect which extends both longitudinally and transversely of the pile fabric. It can also be appreciated that each group of rows of pile tufts has substantially all the alternate rows thereof formed of pile yarns having different color characteristics from at least most of the pile yarns of intervening rows of pile yarns, with different types of pile areas being formed in each group of rows and including one type having high pile tufts in alternate rows and low pile tufts in intervening rows, another type having high pile tufts in intervening rows and low pile tufts in alternate rows, and still another type having pile tufts in both the alternate and intervening rows of substantially common height.

In the drawings and specification there has been set forth a preferred embodiment of the invention and, although specific terms are employed, they are used in a generic and descriptive sense only, and not for purposes of limitation.

That which is claimed is:

1. A tufted pile fabric having groups of longitudinally extending zig-zag rows of yarn pile tufts disposed in parallel relation to each other, each group of rows comprising a plurality of alternate and intervening rows of pile tufts and defining longitudinally arranged pile areas, with the pile areas presenting different color and pattern effects within each group and among the various groups, substantially all the yarns being high bulk space dyed yarns having varying color characteristics along their length and wherein the pile yarns of alternate rows of pile tufts in each group have color characteristics differing from substantially all of the pile yarns of intervening rows therein, substantially all the intervening rows of pile tufts in at least one of the groups in each pattern repeat being of color characteristics differing from substantially all the intervening rows of pile tufts in the other groups of the pattern repeat, said pile areas being of different types and including a. a first pile area having high cut pile tufts in the alternate rows and low pile tufts in the intervening rows such that the high cut pile tufts substantially conceal the low pile tufts, b. a second pile area having high cut pile tufts in the intervening rows and low pile tufts in the alternate rows such that the high cut pile tufts substantially conceal the low pile tufts, and c. a third pile area having cut pile tufts in alternate and intervening rows of substantially common height, and said first, second and third pile areas being arranged in a predetermined pattern of visually distinct areas within each group and among the various groups, and wherein the pattern arrangment of said different types of pile areas of certain groups is different from that of other groups to present different color and pattern effects as well as different types of said pile areas both longitudinally and transversely of the pile fabric.

2. A tufted pile fabric according to claim 1 wherein the pile yarns have a subtle color variation of a dominant color along their length to provide a mellow visual appearance in those pile areas where the yarns are visible.

3. A tufted pile fabric according to claim 1 wherein at least some of said groups of rows of pile tufts have a contrasting row of pile tufts therein presenting a visible longitudinal line effect and being formed of yarn of color characteristics differing from adjacent pile tufts in the respective groups.

4. A tufted pile fabric according to claim 1 wherein said third pile areas serve as alternate pile areas in each group of rows, and wherein said first pile areas serve as some of the intervening pile areas between said alternate pile areas, and said second pile areas serve as the other intervening pile areas.

5. A tufted pile fabric according to claim 1 wherein each group of yarns has substantially the same number of rows of pile tufts therein.

6. A tufted pile fabric according to claim 1 wherein substantially all of the yarns of the alternate rows throughout all of the groups are of substantially the same color characteristics.

7. A tufted pile fabric according to claim 1 wherein the low pile tufts in said first and second pile areas are loop pile tufts.

8. A tufted pile fabric according to claim 1 wherein said high pile tufts in said first and second pile areas and substantially all of the tufts in said third pile areas are of about the same height.

9. A tufted pile fabric according to claim 1 wherein said zig-zag rows include successive diagonally extending sections between the bends in the rows, with each section having a plurality of pile tufts therein.

10. A tufted pile fabric according to claim 1 wherein alternate groups of rows have correspondingly arranged and transversely aligned first, second, and third pile areas.

11. A tufted pile fabric according to claim 1 wherein substantially all of said groups of rows of pile tufts are of about the same width transversely of the fabric, and said first, second, and third pile areas of each group of rows are collectively arranged to define longitudinally arranged squares, with the squares of each group being transversely aligned with the squares in adjacent groups and with the transversely adjacent squares being of differing color characteristics to define a pattern of such squares both longitudinally and transversely of the pile fabric.

12. A tufted pile fabric according to claim 11 wherein each of said squares has a major area portion comprising a pair of pile areas of one of said different types of pile areas spaced apart from each other, and the remaining area portion of another of said different types of pile areas and positioned between said pair of pile areas and also being in the form of a transversely extending narrow strip.

13. A tufted pile fabric according to claim 12 wherein said remaining area portion of each of said squares is centrally disposed within such square and is transversely aligned with the respective remaining area portions of the transversely adjacent squares so as to present a visible transverse line effect across the fabric.

14. A tufted pile fabric according to claim 13 wherein each of said groups of rows of pile tufts has a contrasting row of pile tufts centrally positioned therein so as to present a visible longitudinal line effect along the pile fabric.

* * * * *